US008033071B2

(12) United States Patent
Miyata et al.

(10) Patent No.: US 8,033,071 B2
(45) Date of Patent: Oct. 11, 2011

(54) PARTITION PANEL AND A METHOD OF ASSEMBLING IT

(75) Inventors: Yasuhiko Miyata, Yokohama (JP); Tsuneo Shimomura, Yokohama (JP)

(73) Assignee: Okamura Corporation (JP)

( * ) Notice: Subject to any disclaimer, the term of this patent is extended or adjusted under 35 U.S.C. 154(b) by 345 days.

(21) Appl. No.: 12/166,846

(22) Filed: Jul. 2, 2008

(65) Prior Publication Data

US 2009/0007506 A1 Jan. 8, 2009

(30) Foreign Application Priority Data

Jul. 3, 2007 (JP) ..... 2007-174734
Aug. 24, 2007 (JP) ..... 2007-219028

(51) Int. Cl.
*E04C 2/34* (2006.01)

(52) U.S. Cl. ..... 52/481.2; 52/476; 52/483.1; 52/239; 52/243.1

(58) Field of Classification Search ..... 52/474, 52/475.1, 476, 481.2, 483.1, 238.1, 243, 52/239, 243.1; 403/353, 252, 255, 264
See application file for complete search history.

(56) References Cited

U.S. PATENT DOCUMENTS 3,477,684 A * 11/1969 Dagiel ..... 249/189
4,123,879 A * 11/1978 Blodee et al. ..... 52/36.6
4,423,573 A * 1/1984 Omholt et al. ..... 52/145
4,535,577 A * 8/1985 Tenser et al. ..... 174/495
4,570,390 A * 2/1986 Wendt ..... 52/36.6
4,573,300 A * 3/1986 Bezner ..... 52/563
4,581,859 A * 4/1986 Doke et al. ..... 52/36.6
4,828,005 A * 5/1989 Notley ..... 160/351
4,996,811 A * 3/1991 Dull et al. ..... 52/241
5,062,246 A * 11/1991 Sykes ..... 52/126.4
5,175,969 A * 1/1993 Knauf et al. ..... 52/239
5,285,602 A * 2/1994 Felton ..... 52/36.6
5,377,461 A * 1/1995 DeGrada et al. ..... 52/126.4
5,452,547 A * 9/1995 Baloga et al. ..... 52/32
5,487,246 A * 1/1996 Hodges et al. ..... 52/220.7
5,642,593 A * 7/1997 Shieh ..... 52/239
6,023,896 A * 2/2000 Rothschild ..... 52/243.1
6,167,664 B1 * 1/2001 Reuter et al. ..... 52/239
6,339,907 B1 * 1/2002 Dame et al. ..... 52/239
6,351,917 B1 * 3/2002 MacDonald et al. ..... 52/239
6,367,213 B1 * 4/2002 Reuter et al. ..... 52/239
6,546,684 B2 * 4/2003 Waalkes et al. ..... 52/239
6,612,090 B1 * 9/2003 Corden ..... 52/762
6,729,085 B2 * 5/2004 Newhouse et al. ..... 52/239
7,310,918 B1 * 12/2007 Reuter et al. ..... 52/220.7

FOREIGN PATENT DOCUMENTS

JP 2002-174068 A 6/2002

* cited by examiner

*Primary Examiner* — Robert Canfield
*Assistant Examiner* — Brent W Herring
(74) *Attorney, Agent, or Firm* — Fennemore Craig, P.C.

(57) ABSTRACT

A partition panel for dividing a room in an office comprises a pair of decoration panels each having a plurality of engagement holes, a rectangular frame between the pair of decoration panels, and an engagement member having a plurality of hooks. The hooks engage in the engagement holes of the decoration panel. The engagement member is fixed to the frame.

Another partition panel comprises a rectangular frame having a vertical rod, a plurality of panels on the rectangular frame, and an engagement member having a plurality of hooks and screw holes. The engagement member is fixed to the vertical rod of the frame with screws.

The partition panel can be assembled easily.

12 Claims, 14 Drawing Sheets

119
125a
130
115
117
102
102a
101
131
B
132
126
125
115a
122a
122

PARTITION PANEL AND A METHOD OF ASSEMBLING IT

BACKGROUND OF THE INVENTION

The present invention relates to a partition panel for partitioning the interior of an office and a method of assembling the partition panel.

Conventionally, in a fixed partition panel, a frame is assembled and a decoration panel is mounted to each side of the decoration panel.

JP2004-174068A discloses a moving partition device in which a partition panel suspends from a runner moving along a rail on a ceiling. But in the partition panel, it is very difficult to mount a decoration panel to a frame that suspends from the runner and to mount a closing member for closing a gap with the ceiling or floor, and Al alloy peripheral member to the periphery of the partition panel. It is necessary to assemble the panel in a factory preliminarily.

It is important to keep unity in design between a moving partition panel and a fixed partition panel and to assemble the moving partition panel by oneself. Conventional moving partition panels are too complicated for assembling and do not satisfy the requirements.

If a partition panel comprises a decoration panel and a glass panel, it will be more difficult to assemble it.

SUMMARY OF THE INVENTION

In view of the disadvantages, it is an object of the invention to provide a partition panel that is simple in structure and can be easily assembled.

It is another object of the invention to provide a method of assembling the partition panel by oneself.

BRIEF DESCRIPTION OF THE DRAWINGS

The features and advantages of the invention will become more apparent from the following description with respect to embodiments as shown in accompanying drawings.

DETAILED DESCRIPTION OF PREFERRED EMBODIMENTS

Figure 1:
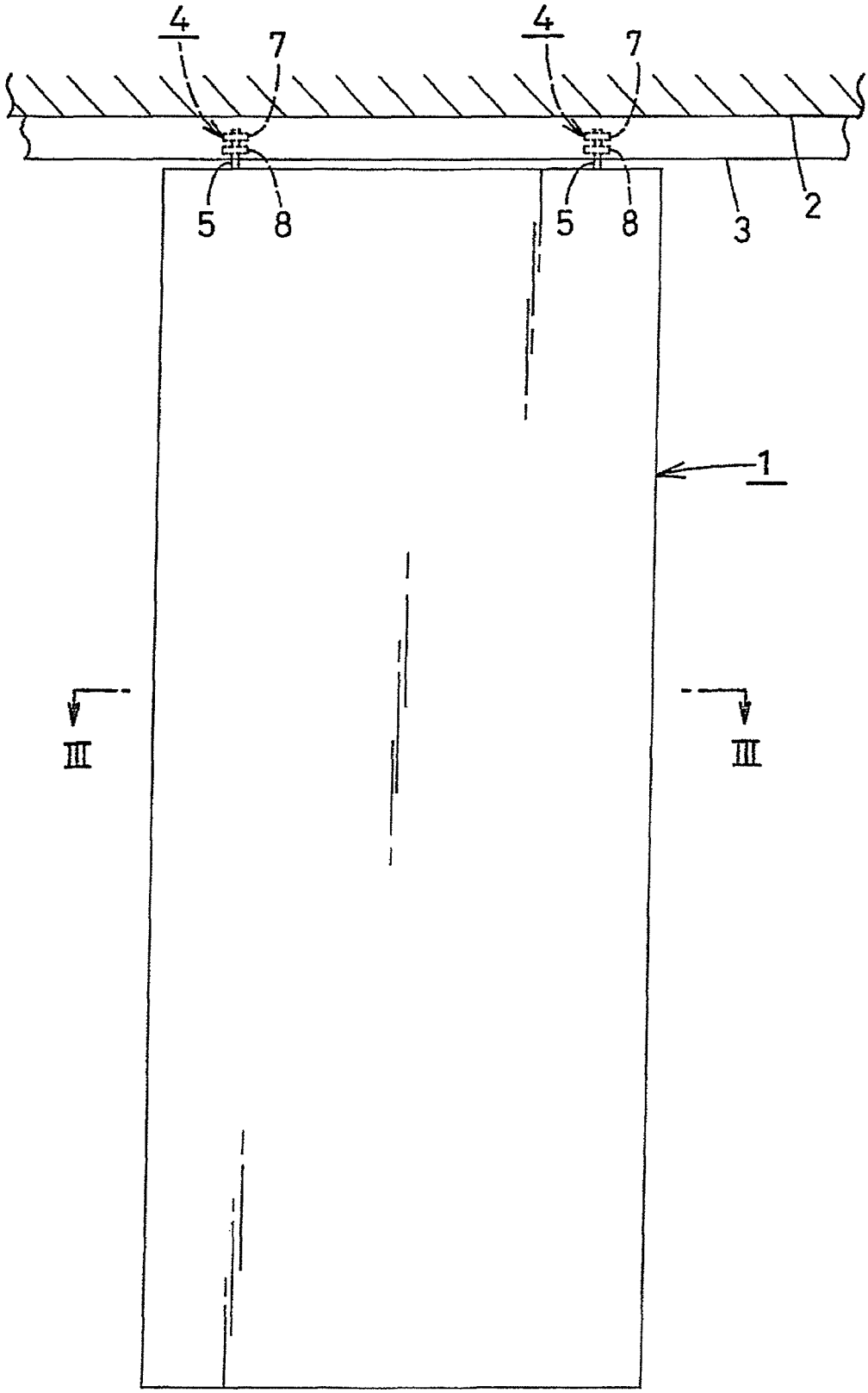
FIG. 1 is a side elevational view showing the first embodiment of a partition panel according to the present invention, the panel suspending from a runner moving along a rail on a ceiling.

A partition panel 1 in the first embodiment according to the present invention suspends with a pair of suspending bolts 5,5 from runners 4,4 moving along a rail 3 fixed to the lower surface of a ceiling 2.

The runner 4 may be any types, and comprises a pair of horizontal rollers 7,8 pivotally connected and spaced vertically with a spacer 6 at the upper end of the suspending bolt 5 in the embodiment.

Figure 2:
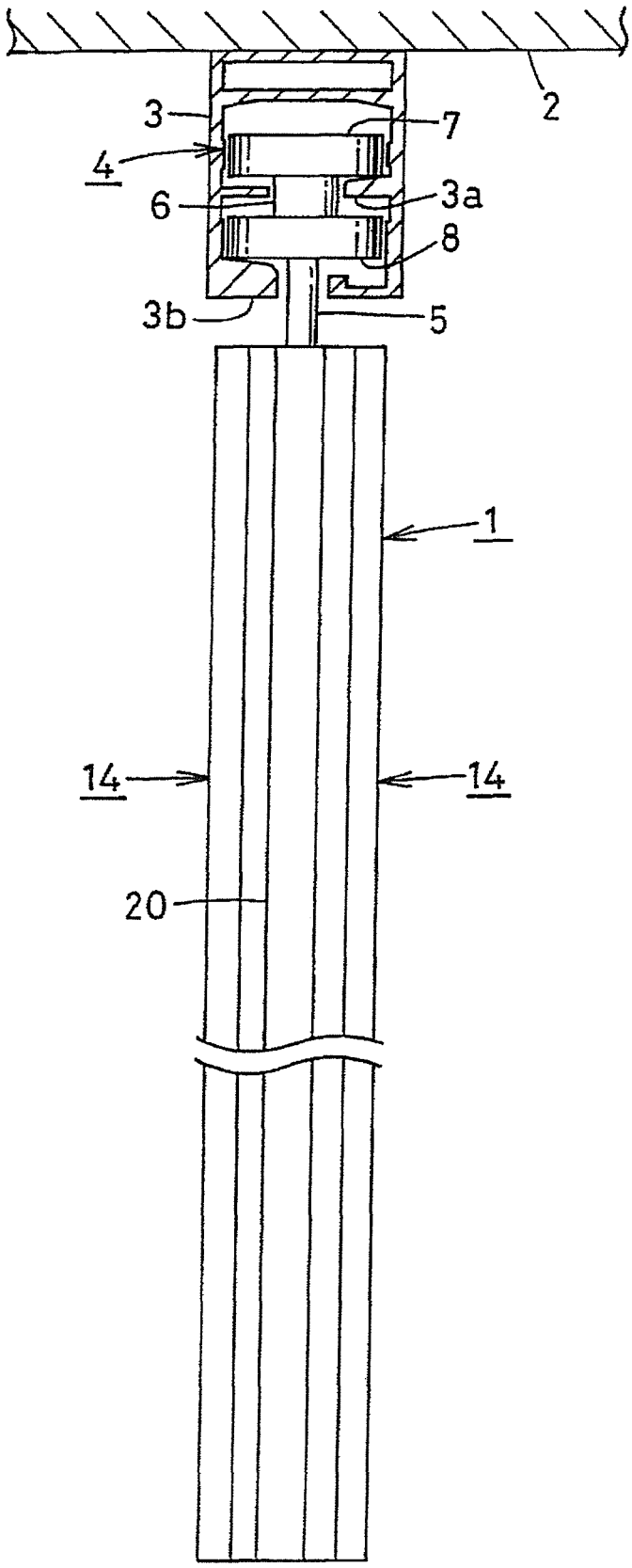
FIG. 2 is an enlarged vertical sectional side view seen from the left.

In FIG. 2, the upper roller 7 is supported on a roller support 3*a* projecting inward from the inner surface of the rail 3 that is open at the lower end, and the lower roller 8 is supported on a roller support 3*b* projecting inward from the inner surface of the rail 3. The upper roller 7 and lower roller 8 move on the roller supports 3*a*,3*b* respectively while they rotate in a reverse direction from each other.

Figure 4:
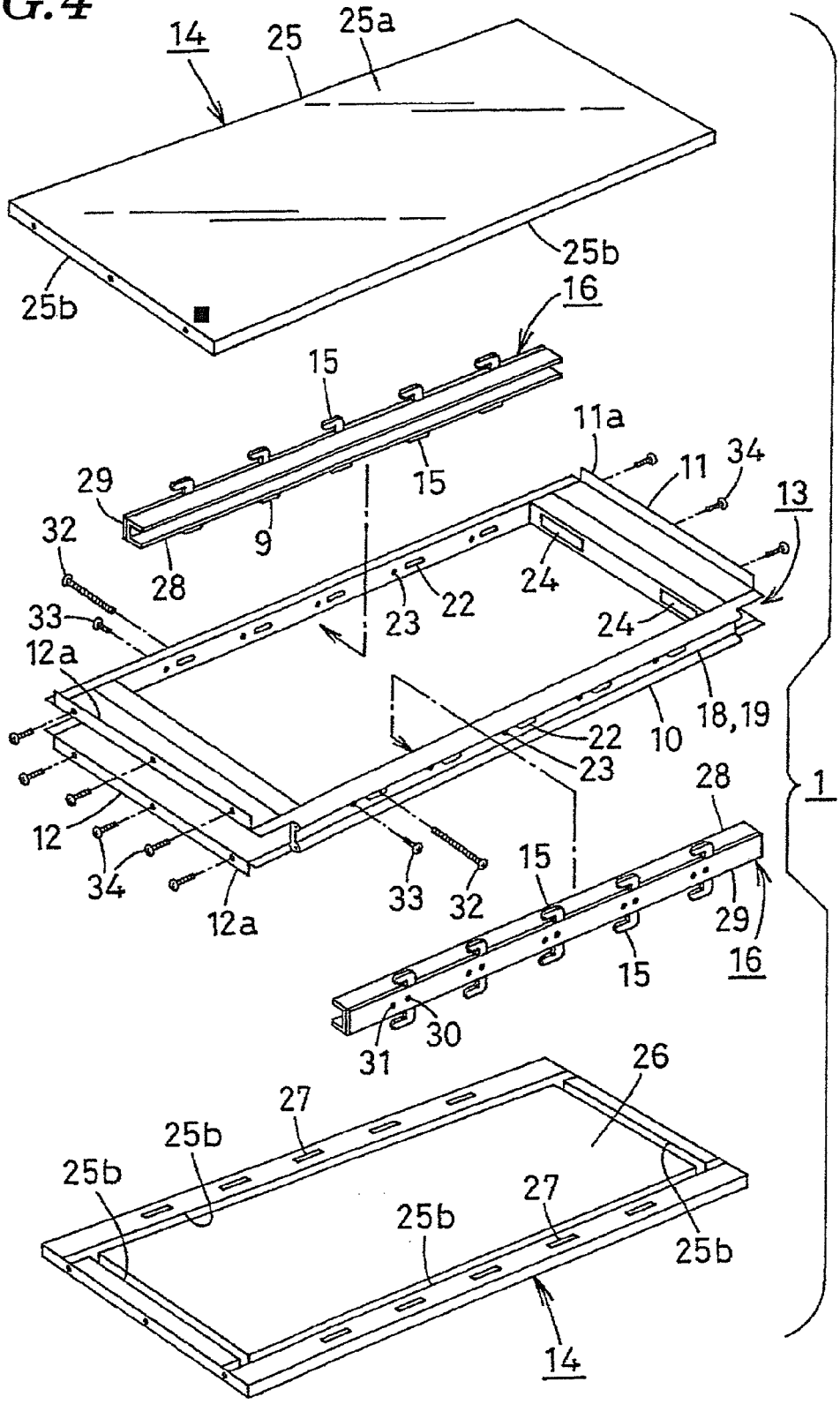
FIG. 4 is an exploded perspective view showing assembling of the partition panel.

In FIG. 4 showing how to assemble the partition panel 1 that is horizontally disposed, the partition panel 1 comprises a rectangular frame 13 that comprises right and left vertical rods 9,10 coupled to each other with lateral rods 11,12; a pair of decoration panels 14,14 having the same dimension and the same structure as each other at each side of the frame 13; and an engagement member 16 disposed along the inner sides of the vertical rods 9,10 and having at each side edge a plurality of hooks 15 that engages with the partition panels 14,14.

The vertical rods 9,10 are made of extruded Al alloy.

Figure 3:
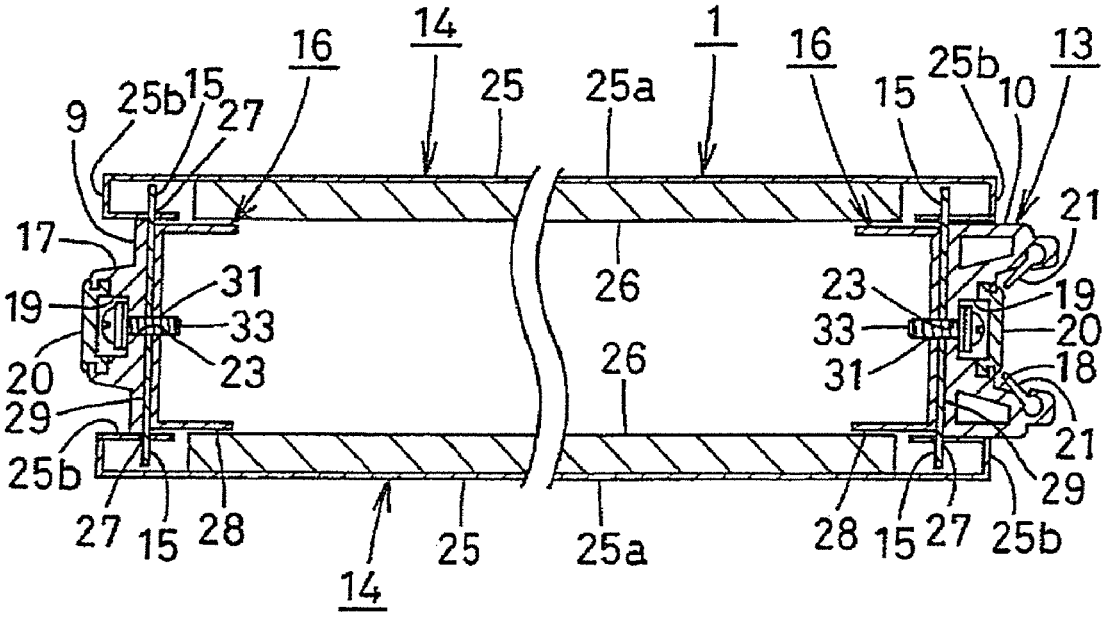
FIG. 3 is an enlarged vertical sectional plan view taken along the line III-III in FIG. 1.

In FIG. 3, a projection 17 is formed at an outer side surface of the vertical rod 9, and a groove 18 is formed at an outer side surface of the vertical rod 10 which fits in the projection 17. The top of the projection 17 and the bottom of the groove 18 have a recess 19.

A closure 20 made of elastic material such as rubber is detachably mounted to an opening of each of the recesses 19. A pair of sealing members 21,21 made of elastic material such as rubber is provided in the inner side surfaces of the groove 18.

A plurality of elongate holes 22 and a plurality of screw-passing holes 23 are spaced longitudinally or vertically in use in the outer sides of the right and left vertical rods 9,10.

The upper and lower lateral rods 11,12 comprise rectangular metal pipes or channels and have at each side through holes 24,24 through which suspension bolts 5,5 or another member pass.

There are closing members for closing a gap between the upper end of the partition panel 1 and the ceiling 2 and a gap between the lower end thereof and a floor (not shown), means for moving the closing members; and means for connecting the lower ends of the suspension bolts 5, 5 to each other, which are not connected with the present invention and illustration and detailed description thereof are omitted.

In FIG. 4, at the upper end of the upper lateral rod 11 and the lower end of the lower lateral rod 12, there are outward projections 11*a*,11*a*,12*a*,12*a* which contact the upper end face and lower end face of each of the decoration panel 14.

In FIGS. 3 and 4, in the decoration panel 14, the peripheral edge of a flat part 25*a* of a metal decoration plate 25 is folded inward like U to form a folded edge 25*b*. A plaster board 26 is fixed on the back surface of the flat part 25*a* inside the folded edge 25*b*.

In the back surface of the right-and-left folded edge 25*b* of the decoration panel 14, there is a plurality of engagement holes 27 or engagement holes that engage with a plurality of hooks 15 on the side of the engagement member 16.

The right and left engagement members 16,16 comprise a U-shaped channel bar 28 and a metal base 29 having a plurality of hooks 15 directing in the same direction. The channel bar 28 is fixed to the base 29 by spot welding. The engagement member 16 has screw holes 30 corresponding to the elongate holes 22 of the vertical rods 9,10 of the frame 13 and screw holes 31 corresponding to the screw-passing holes 23 in the longitudinal direction.

Figure 5:
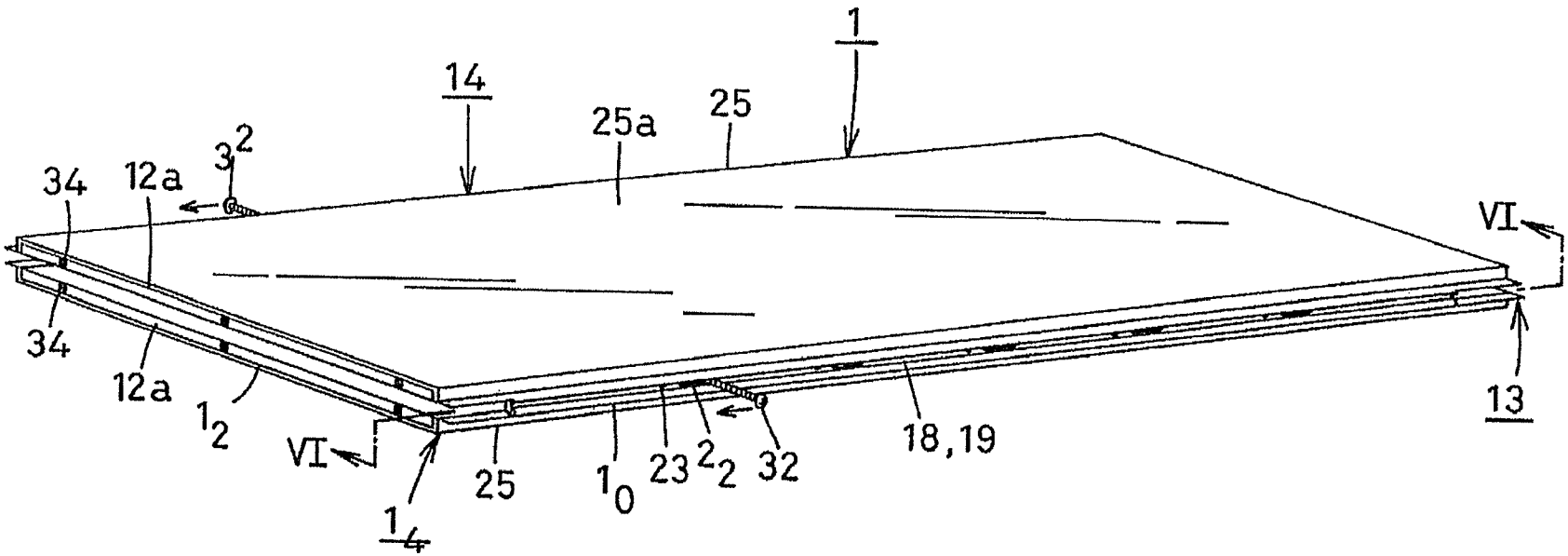
FIG. 5 is a perspective view showing the unfinished partition panel.
Figure 6:
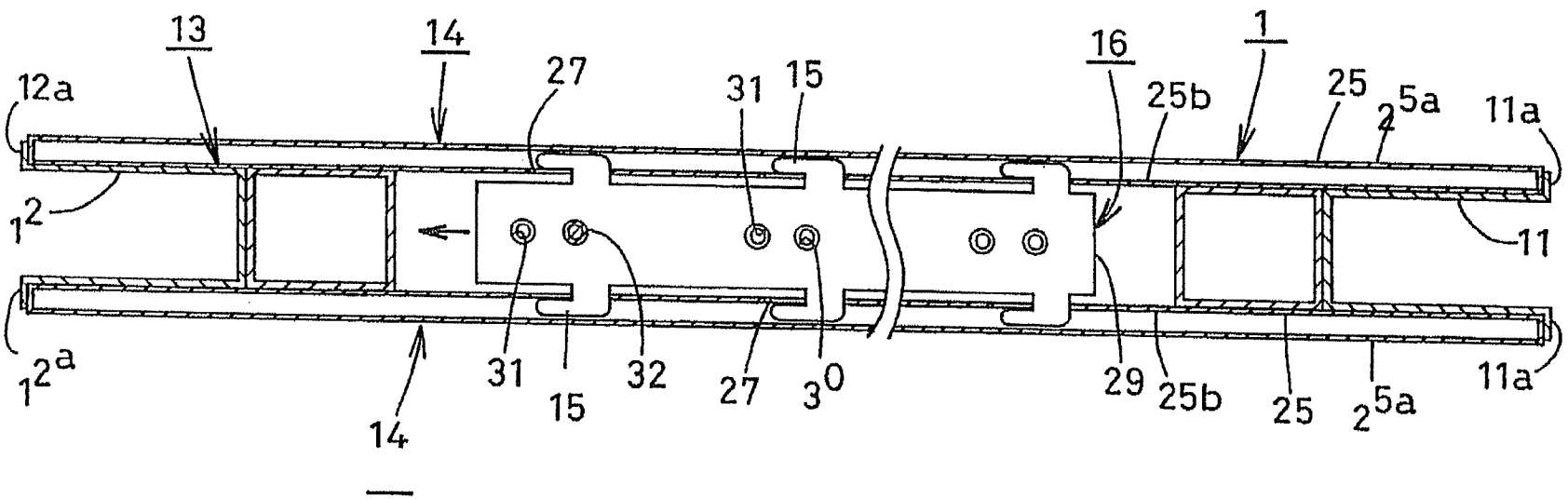
FIG. 6 is a vertical sectional front view taken along the line VI-VI in FIG. 5.

In FIGS. 4-6, how to assemble the partition plate 1 will be described.

In FIG. 4, the single decoration panel 14 is horizontally positioned with the bottom up on the floor or a support (not shown). Then, the projections 11*a* and 12*a* contact the end faces of the decoration panel 14 to hold the decoration panel 14 which is horizontally disposed. A pair of engagement members 16,16 is disposed along the inner sides of the vertical rods 9,10 such that a plurality of hooks 15 engages in the engagement holes 27 of the decoration panel 14, and the hooks 15 on the other edge project upward from the horizontal frame 13. Another decoration panel 14 with the bottom down is horizontally disposed. Each of the engagement holes of the decoration panel 14 engages with each of the hooks of the engagement member 16. The decoration panel 14 is held between the projections 11*a* and 12*a* of the frame 13.

Before the decoration panel 14 is disposed over the frame 13, the suspension bolts 5,5, means for connecting lower ends and closing members and means for moving them are equipped, if necessary.

While the frame 13 and the engagement members 16,16 are sandwiched between the upper and lower decoration panels 14 and 14, the ends of a pair of bolts 32,32 for moving the engagement member 16 engage in any one of the screw holes 30,30 of the engagement members 16,16 through any one of right and left elongate holes 22,22.

Before the upper decoration panel 14 is disposed over the frame 13, the end of the bolt 32 passing through the elongate hole 22 may engage with the screw hole 30 of the engagement member 16.

As shown by an arrow in FIG. 5, the right and left bolts 32,32 are grasped and moved along the elongate holes 22,22 in a direction of the end of the hook 15 or for left side in FIG. 4 to allow the right-and-left engagement members 16,16 to move with respect to the frame 13 and the upper and lower decoration panels 14,14 in a direction as shown by an arrow in FIG. 6 to enable each of the hooks 15 to engage with the edge of each of the engagement holes 27.

When each of the hooks 15 completely engages with the edge of each of the engagement holes 27, the screw holes 31 and screw-passing holes 23 are defined in a position such that all the screw holes 31 of each of the engagement members 16 coincide with the screw-passing holes 23 of the frame 13. When they coincide with each other, the screw 33 is tightened in the screw hole 31 through the screw-passing hole 23, so that the engagement member 15 is fastened to the frame 13.

The projections 11*a*,12*a* of the frame 13 are fastened to the upper and lower end faces of the decoration panel 14 with screws 34. The screws 34 may be tightened when the frame 13 is disposed on the frame 13 and when another decoration panel 14 is disposed on the frame 13.

With the screws 33,34, the engagement members 16,16 and decoration panels 14,14 are firmly fastened to the frame 13 to produce the partition panel 1.

After completion of the partition panel 1, the bolts 32 are taken off and can be utilized again for assembling a next partition panel.

After completion of the partition panel 1, the runners 4,4 at the end of the suspension bolts 5,5 are provided in the rail 3 to enable the partition panel 1 suspending from the rail 3 to move.

As clarified above, the partition panel and a method of assembling it according to the present invention allow a single person to assemble the partition panel 1 easily and readily. The reduced number of parts in the partition panel simplify its structure.

On any one of the upper and lower ends of the frame 13, the outward projection 12*a* prevents the decoration panel 14 from moving in a direction in which the periphery around the engagement hole 27 that engages with the hook 15 goes off the hook 15. Thus, the decoration panel 14 is mounted to the frame 15 securely.

The present invention is not limited to the foregoing embodiment. Variations may be made without departing from the scope of claims.

For example, in the embodiment, there are a plurality of elongate holes and screw-passing holes in each of the vertical rods 9,10 and a plurality of screw holes in each of the engagement member 16. But at least one may be formed.

In the foregoing embodiment, when the partition panel 1 suspends from the suspension bolts 5,5, each of the hooks 15 of the engagement member 16 directs downward. Hooks may direct upward, and the upper edge of the engagement hole 27 of the decoration panel 14 engages on the hooks. Thus, each of the decoration panels 14 engages on the frame 15 only with the hooks, and the projections 11*a*,12*a* may be omitted in the frame 15.

Engagement holes are formed at each side of the engagement member 16. After the hooks that project from the rear surface of the decoration panel engage in the engagement holes, the engagement member may move in a direction where the hook deeply engages with the edge of the engagement hole.

In the embodiment, the present invention applies to a moving partition panel. But the present invention may apply to a fixed partition panel.

Figure 7:
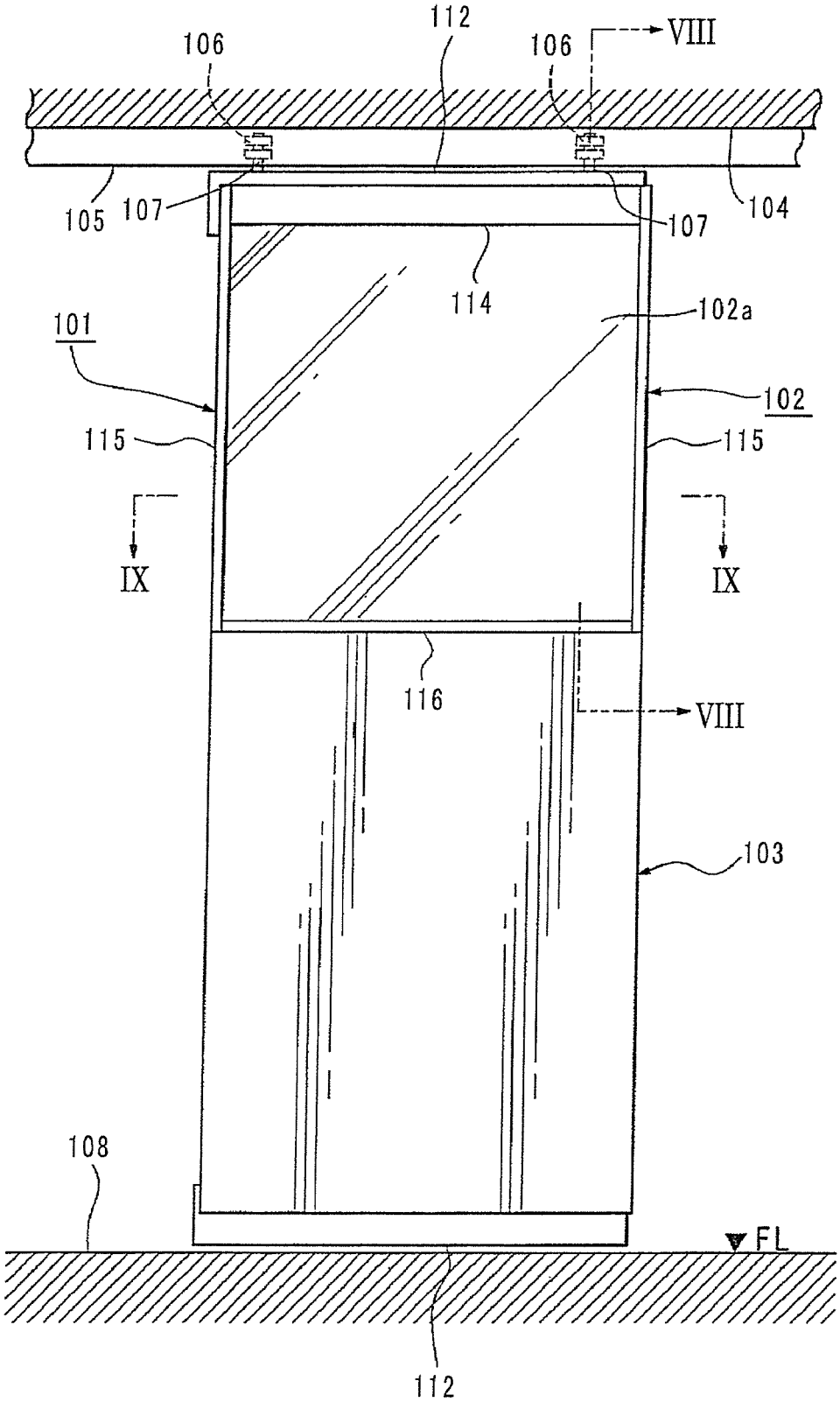
FIG. 7 is a front elevational view of the second embodiment of a partition panel according to the present invention to show that the partition panel suspends from a runner moving along a rail on a ceiling.
Figure 8:
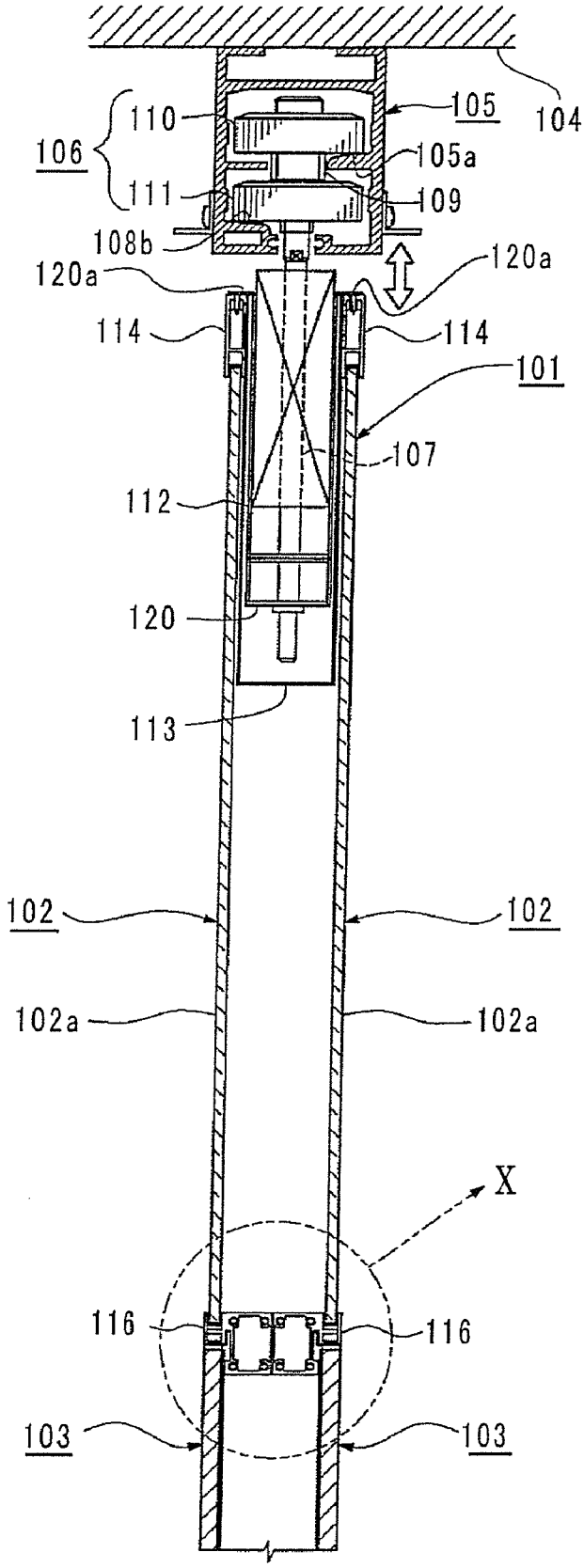
FIG. 8 is a vertical sectional side view taken along the line VIII-VIII in FIG. 7.

FIG. 7 shows the second embodiment of a partition panel according to the present invention. A partition panel 101 in the embodiment has a height close to a ceiling height in a room. The upper half of the partition panel 101 comprises a see-through panel 102 that comprises transparent or translucent plate glass or acryl plate with or without decoration, or a net or lattice. The lower half comprises a pair of steel decoration panels 103. The upper end of the partition panel 101 suspends from a pair of runners 106,106 moving along a rail 105 fixed to the lower surface of a ceiling 104, and the lower end moves close to the floor surface FL of a floor 108. Through the upper see-through panel 102 of the partition panel 101, visibility is assured in the room divided by the partition panel 102.

The runner 106 may be any types and comprises a pair of horizontal rollers 110,111 spaced vertically with a spacer 109 at the upper end of a suspending bolt 107.

The upper roller 110 is rotatably supported on a roller support 5*a* projecting inward from the inner surface at one side of the rail 5 that is open at the lower end, and the lower roller 111 is rotatably supported on a roller support 105*b* projecting inward from the inner surface at the other side of the rail 105. The rollers 110,111 rotate reversely from each other and move along the rail 105 at the same time.

At the upper and lower ends of the partition panel 101, between the upper end of the partition panel 101 and the lower surface of the rail 105 and between the lower end of the partition panel 101 and the floor surface FL, there are gap-closing members 112,112 that move up and down.

Means for moving the gap-closing members 112,112 does not directly relate to the present invention, and illustration and description therefor are omitted.

The upper gap-closing member 112, means for moving it, and the suspending bolt 107 from which the partition panel 101 suspends are covered with a shield 113 that is open at the upper end. The shield 113 prevents the inside of the partition panel 101 from being seen from the outside.

The see-through panel 102 comprises a panel base 102*a* such as plate glass; an upper sash 114 covering the upper edge of the panel base 102*a;* a pair of vertical sashes 115,115 covering the right and left side edges of the panel base 102*a;* and a lower sash 116 covering the lower edge of the panel base 102*a*.

The outer circumference of the panel base 102*a* is enclosed by the right and left sashes 115,115 and the upper and lower sashes 114,116.

The lower sash 116 acts as a connector with the upper edge of the decoration panel 103, as a spacer for defining a distance between the see-through panels 102,102, and as a shelter for preventing the inside of the lower partition panel 101 from being seen through the see-through panel 102,102 from the lower end thereof.

Figure 10:
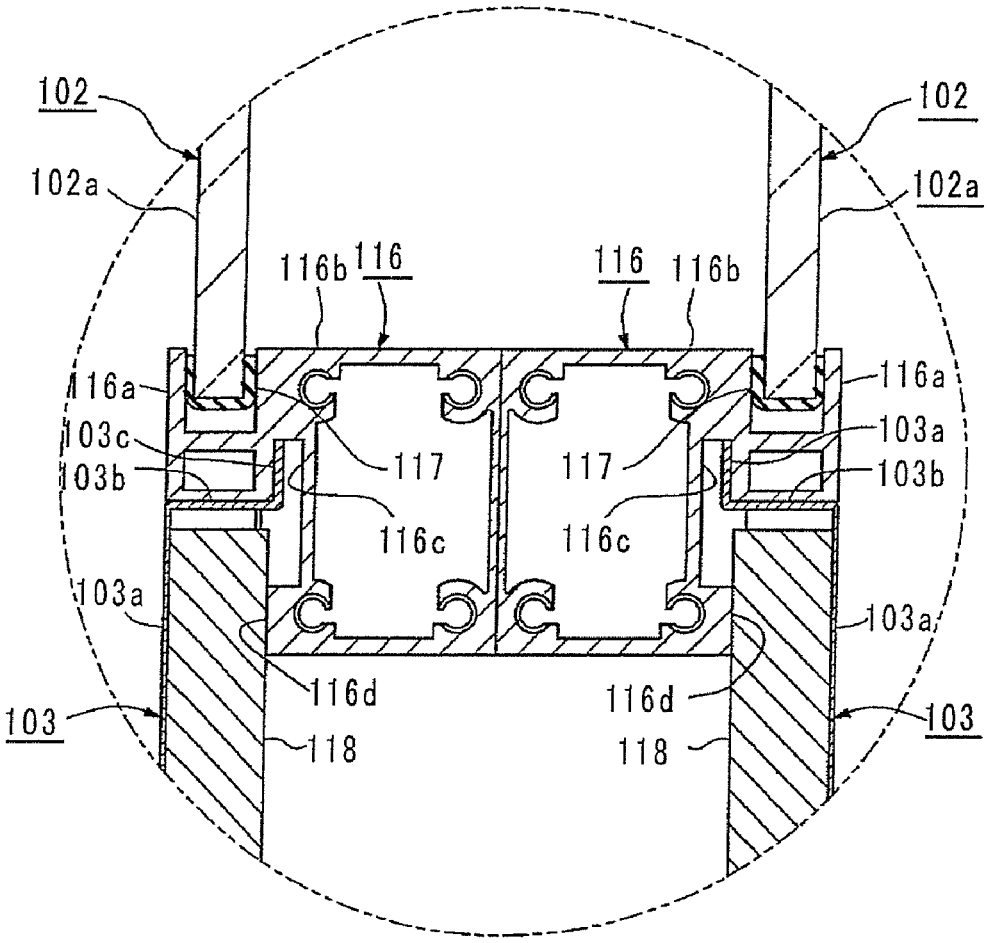
FIG. 10 is an enlarged vertical sectional side view of the part X in FIG. 8.
Figure 11:
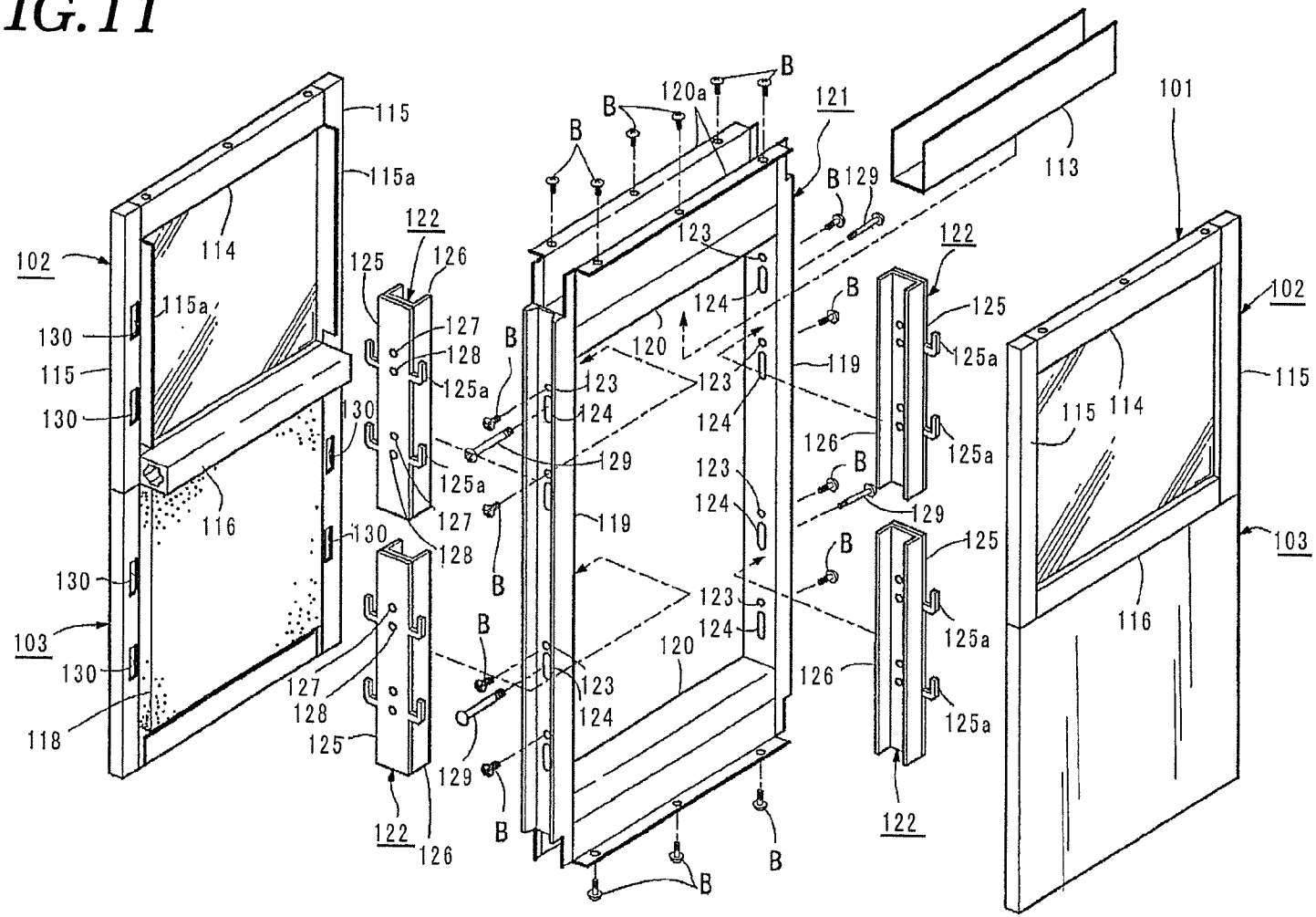
FIG. 11 is an exploded perspective view of the second embodiment of the partition panel according to the present invention.

In FIG. 10, the lower sash 116 made of extruded Al alloy comprises a sash 116*a* in which the lower end of the panel base 102*a* fits with sealing material 117, and a hollow rectangular spacer 116*b* keeping a distance between the see-through panels 102 and 102.

The decoration panel 103 comprises a bent portion 103*b* formed by bending the outer periphery of the thin steel panel base 103*a* at right angles, an upward engagement portion 103*c* and a heat insulator 118 such as plaster board on the rear surface of the panel base 103*a*. The engagement portion 103*c* is put in an engagement groove 116*c* between the lower part of the sash 116*a* and the spacer 116*b*, and the rear surface of the heat insulator 118 contacts a contact portion 116*d* at the lower part of the spacer 116*b* to allow the surface of the decoration panel 103 to contact the front surface of the lower sash 116 of the see-through panel 102, thereby preventing motion of the decoration panel 103 and see-through panel 102 in the forward and backward direction.

Figure 12:
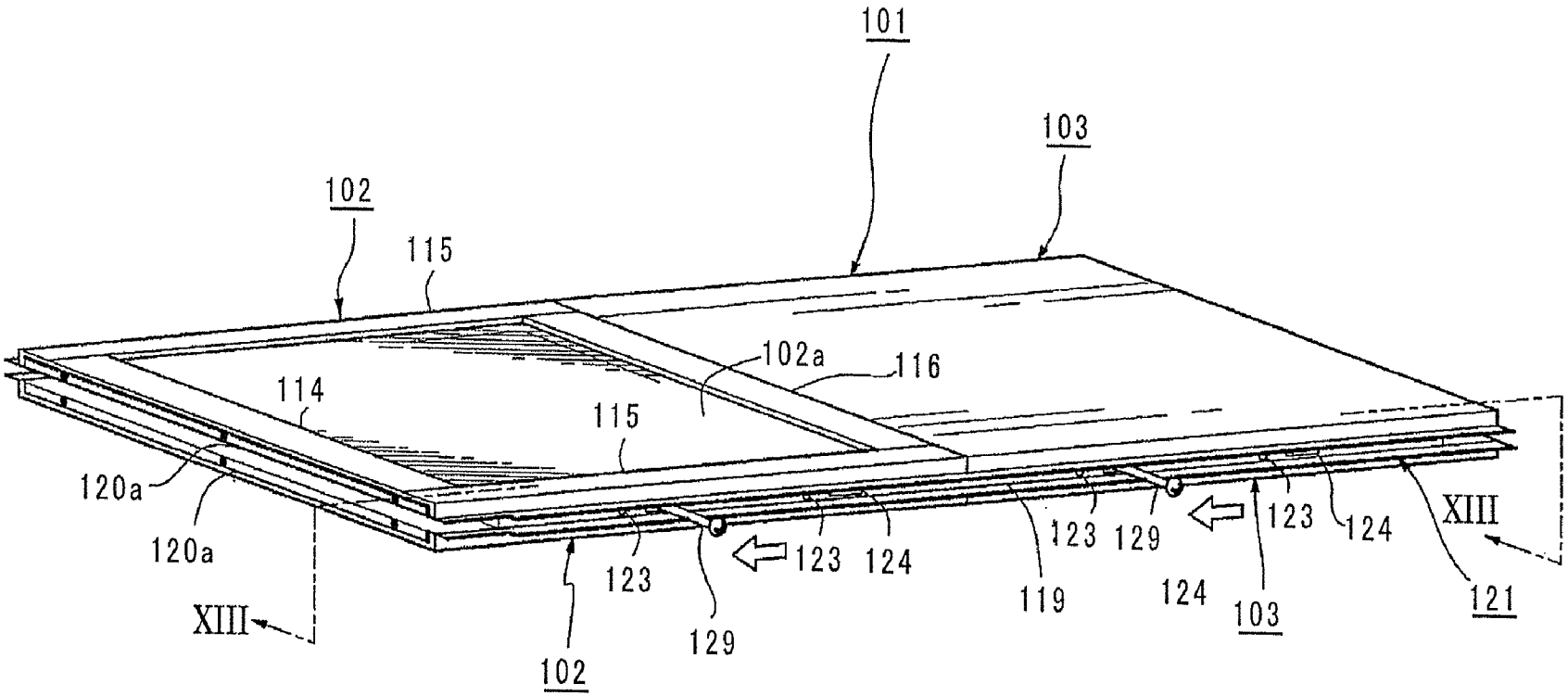
FIG. 12 is a perspective view showing the unfinished partition panel.

FIG. 12 shows the disassembled partition panel 101 in which the see-through panel 102 and decoration panel 103 are fixed with the engagement members 122 on each side of the rectangular frame 121 comprising a pair of vertical rods 119, 119 coupled with the lateral rods 120,120.

The vertical rod 119 is made of extruded Al alloy and has a plurality of screw-passing holes 123 and elongate holes 124 longitudinally.

The upper end of the upper lateral rod 120 and the lower end of the lower lateral rod 120 are open upward and downward respectively and include the gap-closing member 112 that moves up and down. The outward flanges 120*a*,120*a* are formed so that the upper end of the see-through panel 102 and the lower end of the decoration panel 103 may be mounted.

The front and rear portions of the shield 113 are bonded on the inner surface of the upper lateral rod 120. Alternatively, an outward projection (not shown) at the upper end of the front and rear portions of the shield 113 contact the lower surfaces of the flanges 120*a*,120*a* and may be fastened to the flanges 120*a*,120*a* with screws B.

The engagement member 122 is disposed on the inner surface of the vertical rod 119, and comprises a vertical member 125 having a plurality of L-shaped hooks 125*a* on the side and a reinforcement 126 welded to the vertical member 125. A plurality of fixing screw holes 127 and moving screw holes 128 pass through the vertical member 125 and the reinforcement 126 respectively.

They are corresponding to the screw-passing hole 123 and elongate hole 124. A bolt 129 for movement is put through the elongate hole 124, and the end thereof is engaged in the screw hole 128 of the engagement member 122. Thus, the engagement member 122 is moved up and down with the bolt 129. When it is visually confirmed that the screw-passing hole 123 of the vertical rod 119 coincides with the screw hole 127 of the engagement member 122, the screw B is passed through the screw-passing hole 123 to engage in the screw hole 127, so that the engagement member 122 is fixed.

Corresponding to the hook 125*a* of the engagement member 122, a plurality of elongate engagement holes 130 is formed at each side of the rear surfaces of the vertical sashes 115 of the see-through panel 102 and of the rear surface of the decoration panel 103. While the hook 125*a* engages with the upper edge of the engagement hole 130, each side of the see-through panel 102 and decoration panel 103 is positioned and fixed.

In the rear surface of the right-and left vertical sashes 115 of the front and rear see-through panels 102, shielding projections 115*a*,115*a* are provided respectively such that the projections of the facing front and rear see-through panels contact each other or are close to each other. The engagement member 122 and screws therefor are covered with the projections 115*a*,115*a*, so that the they are not seen from the outside through the see-through panels 102,102 to provide good appearance.

Figure 13:
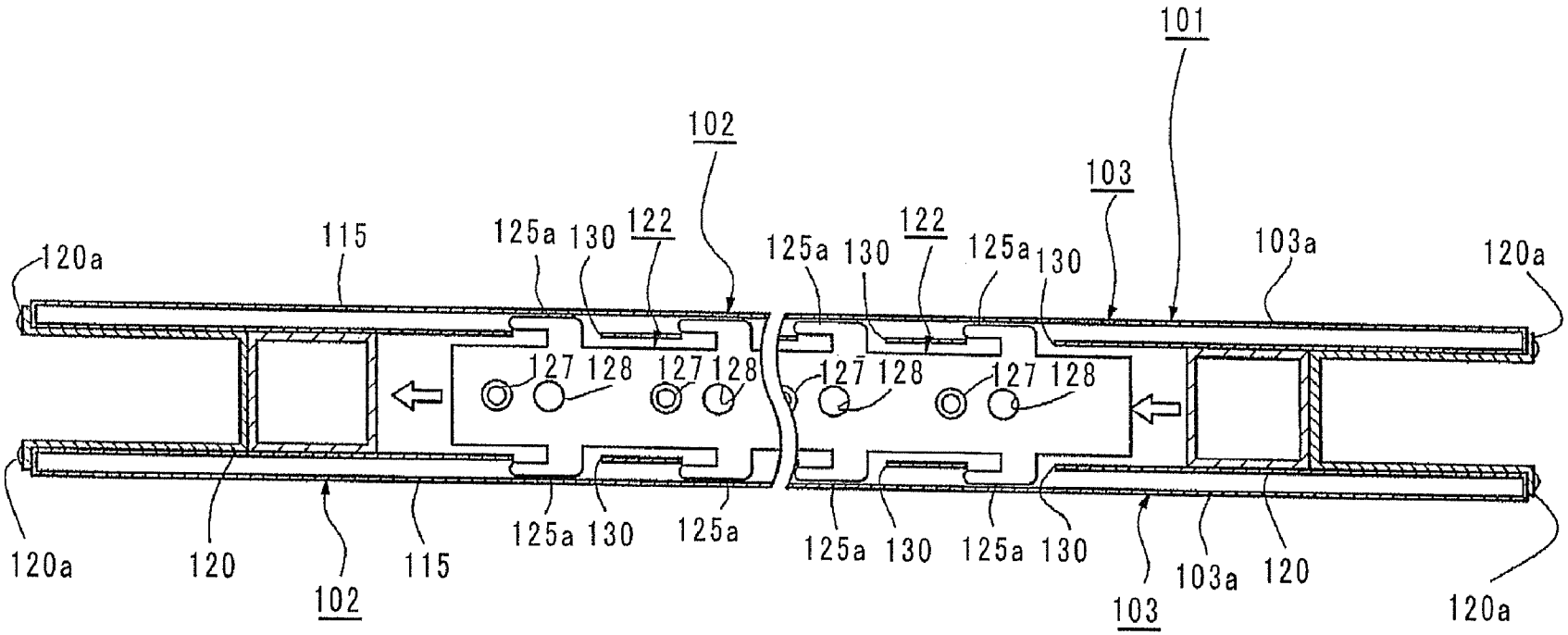
FIG. 13 is a vertical sectional view taken along the line XIII-XIII in FIG. 12.

To assemble the partition panel 101, in FIGS. 12 and 13, the engagement member 122 is provisionally fastened with the bolts 129 to the sides of the frame 121. While the front and rear surfaces of the frame 121 are held between the front and rear see-through panels 102 and decoration panels 103, they are placed horizontally on the floor surface or suitable support (not shown).

The see-through panel 102 and the decoration panel 103 are held between the flanges 120*a*,120*a* of the upper and lower lateral rods 120,120, and the hook 125*a* of each of the engagement members 122 engages with the engagement hole 130 of the corresponding see-through panel 102 and decoration panel 103. The frame 121 and engagement member 122 are put over the see-through panel 102 and decoration panel 103, and another see-through panel 102 and decoration panel 103 are put as well.

Then, the moving bolt 129 is moved in a direction of an arrow in FIGS. 12 and 13 or in a direction of the hook 125*a* to allow the hook 125*a* to engage with the edge of the engagement hole 130. The screw hole 127 of the engagement member 122 coincides with the screw-passing hole 123. The fixing screw B is passed through the screw-passing hole 123 to engage with the screw hole 123, so that the see-through panel 102 and the decoration panel 103 are positioned and fixed to the frame 121.

Then, the upper end of the see-through panel 102 and the lower end of the decoration panel 103 are screwed into the flanges 120*a*,120*a* of the upper and lower lateral rods 120,120 with the fixing screws B.

In the embodiment, the see-through panel 102 and the decoration panel 103 are mounted to the frame 121 with a plurality of engagement members 122, but may be fixed by a single engagement member.

As an alternate order for assembling, the upper end of the see-through panel 102 and lower end of the decoration panel 103 are screwed to the upper and lower flanges 20*a*. Then, each side of the see-through panel 102 and decoration panel 103 may be fixed to the frame 121 with the engagement member 122.

Figure 9:
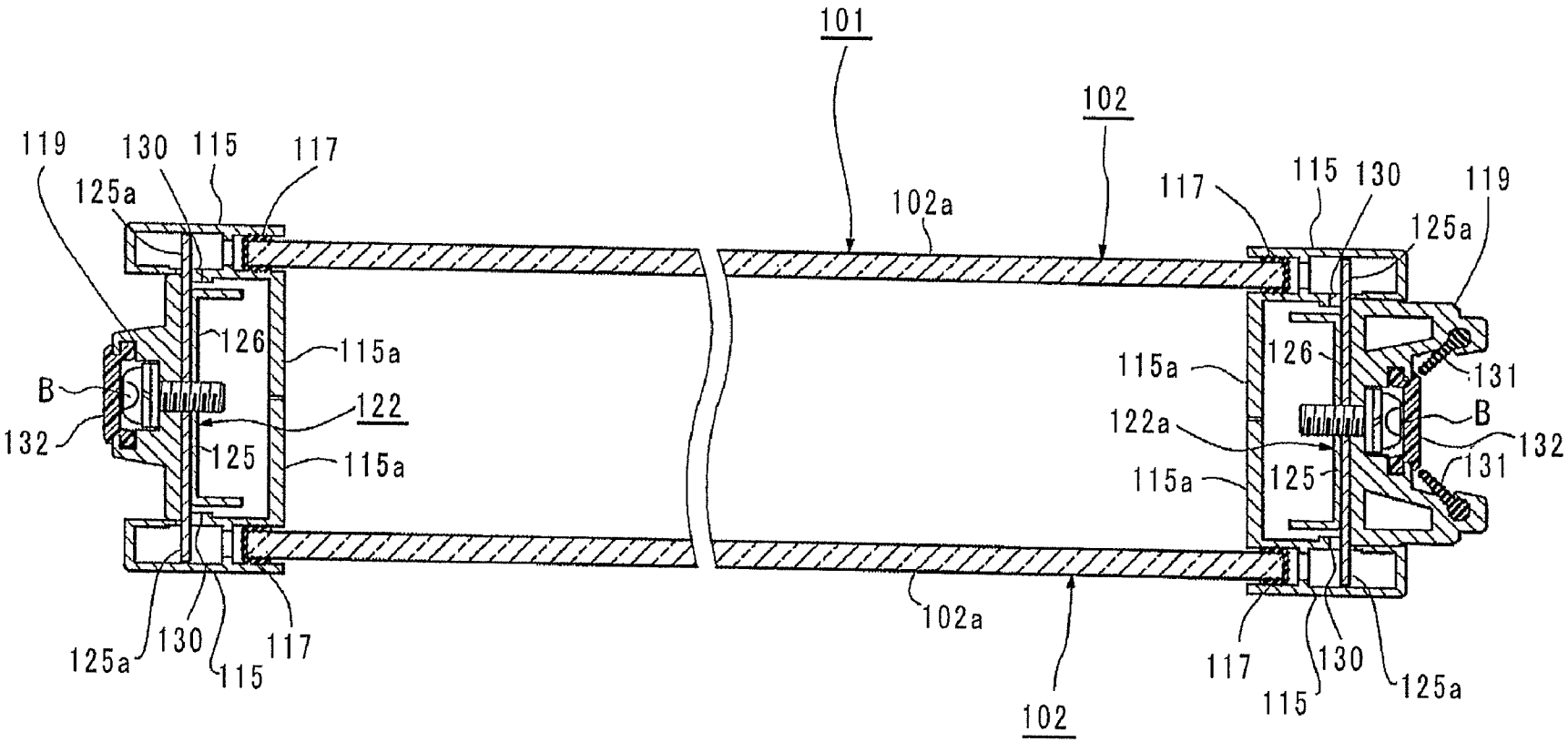
FIG. 9 is a horizontal sectional plan view taken along the line IX-IX in FIG. 7.

FIG. 9 shows a horizontal cross-section of the assembled partition panel 1. The cross section of the right-hand vertical rod 119 in FIG. 9 is concave and includes a pair of sealing members 131.

The left-hand vertical rod 119 which is convex fits with the right-hand vertical rod 119. When the adjacent partition panels 101,101 are connected, the convex fits with the concave to allow the partition panels 101,101 to be placed without gaps.

In the middle of the outer surface of the right and left vertical rods 119,119, a closing member 132 such as rubber is detachably mounted to cover the head of the fixing screw B.

Figure 14A:
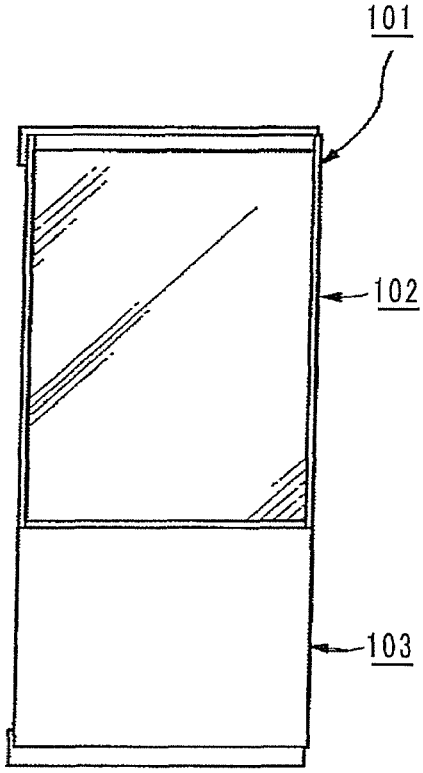
FIGS. 14A, 14B, 14C are front views of three variations of a partition panel according to the present invention respectively.
Figure 14B:
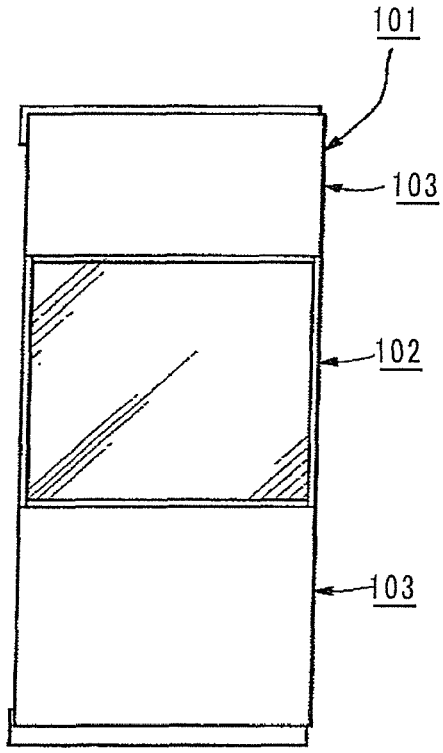
Figure 14C:
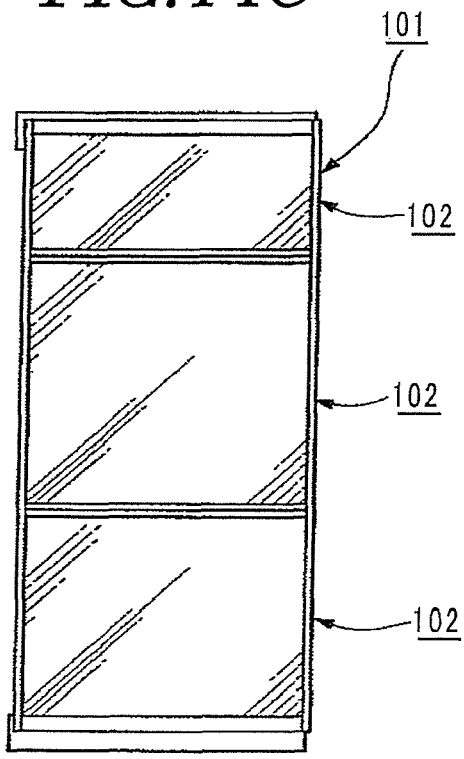

FIGS. 14A,14B,14C show a variation of a partition panel 101.

FIG. 14A shows that a height of an upper see-through panel 102 is about two-thirds of the total height, and the remaining is a decoration panel. FIG. 14B shows that the height of a partition panel 101 is equally divided into three, and a see-through panel is disposed in the middle and the decoration panels 103 are upper and lower than the middle panel. FIG. 14C shows that the total height of a partition panel 101 is divided into three and all is see-through panels 102.

The shape and structure can be selected depending on the purpose and use.

A plurality of panels is mounted vertically only on one side. On the other side, a single panel may be mounted or need not to be mounted.

The foregoing merely relate to embodiments of the invention. Various changes and modifications may be made by a person skilled in the art without departing from the scope of claims wherein:

What is claimed is:

1. A partition panel comprising:

a rectangular frame comprising a pair of vertical rods coupled to each other with a lateral rod, each of the pair of vertical rods having a screw-passing hole and an elongate hole;

a pair of decoration panels having a plurality of engagement holes in each side edge, each of the decoration panels being disposed on each side of the rectangular frame; and an engagement member disposed along an inner side surface of each of the pair of vertical rods of the rectangular frame, the engagement member having a plurality of hooks and being movably mounted along the inner side surface of each of the pair of vertical rods between a first position in which the hooks engage in edges of the plurality of the engagement holes of each of the pair of decoration panels and a second position in which the hooks disengage from the edges of the plurality of the engagement holes, the engagement member having a first screw hole that engages with a moving member passing through the elongate hole of the vertical rod of the frame, and a second screw hole that engages with a fixing screw passing through the screw-passing hole of the vertical rod of the frame, the plurality of hooks engaging with edges of the engagement holes of the pair of decoration panels, the engagement member being fixed to the vertical rod with the fixing screw.

2. The partition panel of claim 1 wherein the frame further comprises an outward projection at upper or lower end to prevent each of the pair of decoration panels from moving in a direction that the edge of the engagement holes of the pair of decoration panels disengages from the hook.

3. The partition panel of claim 1 wherein the moving member comprises a bolt.

4. A partition panel comprising:

a rectangular frame comprising a pair of vertical rods coupled with a lateral rod at an end, each of the pair of vertical rods having a screw-passing hole and an elongate hole;

a plurality of panels having a plurality of engagement holes at each side edge of a rear surface, the plurality of panels being disposed vertically at least on one side of front and rear sides of the frame; and an engagement member having a plurality of hooks and being movably mounted along the inner side surface of each of the pair of vertical rods between a first position in which the hooks engage in edges of the plurality of the engagement holes of each of the pair of the panels and a second position in which the hooks disengage from the edges of the plurality of the engagement holes, a first screw hole that engages with a moving member passing through the elongate hole of the vertical rod of the frame, and a second screw hole that engages with a fixing screw passing through the screw-passing hole of the vertical rod of the frame.

5. The partition panel of claim 4 wherein the plurality of panels is independently fixed to the vertical rod with a plurality of engagement members spaced vertically.

6. The partition panel of claim 4 wherein the plurality of panels separated vertically is fixed to the vertical rod with a single engagement member.

7. The partition panel of claim 4 wherein any of the plurality of panels comprises a pair of see-through panels.

8. The partition panel of claim 7 wherein a portion of the see-through panel is covered with a shield.

9. The partition panel of claim 7, further comprising vertical sashes at side edges of the pair of see-through panels, the sashes having projections opposing each other or being close to each other.

10. The partition panel of claim 4 wherein the frame has a flange at an upper or lower end to prevent the panel from moving in a direction where the hook goes out of the engagement hole.

11. The partition panel of claim 4 wherein the moving member comprises a bolt.

12. A partition panel, comprising:

a rectangular frame comprising at least first and second vertical members positioned in generally spaced-apart relation;

a first engagement member comprising a plurality of hooks extending outwardly therefrom, said first engagement member being moveably mounted to the first vertical member of said rectangular frame so that said first engagement member may be moved between a first position and a second position;

a second engagement member comprising a plurality of hooks extending outwardly therefrom, said second engagement member being moveably mounted to the second vertical member of said rectangular frame so that said second engagement member may be moved between a first position and a second position; and first and second panels positioned on opposite sides of said rectangular frame, each of said first and second panels defining a plurality of holes therein, the plurality of hooks extending from said first and second engagement members engaging respective ones of said plurality of holes in said first and second panels when said first and second engagement members are in the first position, the plurality of hooks extending from said first and second engagement members disengaging respective ones of said plurality of holes in said first and second panels when said first and second engagement members are in the second position, wherein said first and second panels are attached to said rectangular frame when said first and second engagement members are in the first position, and wherein said first and second panels are removable from said rectangular frame when the first and second engagement members are in the second position.

* * * * *